US005605461A

United States Patent [19]

Seeton

[11] Patent Number: 5,605,461

[45] Date of Patent: Feb. 25, 1997

[54] ACOUSTIC TRIGGERED LASER DEVICE FOR SIMULATING FIREARMS

[76] Inventor: Gary E. Seeton, 203 Fireside, College Station, Tex. 77840

[21] Appl. No.: 330,199

[22] Filed: Oct. 27, 1994

[51] Int. Cl.[6] ..... F41G 3/26

[52] U.S. Cl. ..... 434/21; 42/103

[58] Field of Search ..... 434/19, 21, 22; 381/155, 169, 173; 372/31, 38; 42/103

[56] References Cited

U.S. PATENT DOCUMENTS

| | | | |
|---|---|---|---|
| 3,526,972 | 9/1970 | Sumpf . | |
| 3,633,285 | 1/1972 | Sensney . | |
| 3,938,262 | 2/1976 | Dye et al. . | |
| 3,995,376 | 12/1976 | Kimble et al. . | |
| 4,048,489 | 9/1977 | Giannetti . | |
| 4,281,993 | 8/1981 | Shaw . | |
| 4,313,272 | 2/1982 | Matthews . | |
| 4,313,273 | 2/1982 | Matthews et al. . | |
| 4,367,516 | 1/1983 | Jacob . | |
| 4,678,437 | 7/1987 | Scott et al. | 434/21 |
| 4,761,907 | 8/1988 | De Bernardini . | |
| 4,830,617 | 5/1989 | Hancox et al. . | |
| 4,947,859 | 8/1990 | Brewer et al. | 381/169 |
| 5,119,576 | 6/1992 | Erming . | |
| 5,194,007 | 3/1993 | Marshall et al. | 434/21 |
| 5,237,773 | 8/1993 | Claridge . | |

OTHER PUBLICATIONS

Beamhit I IO User's Manual, Beamhit Systems, pp. 1–47 (Apr. 1994).

*Primary Examiner*—Richard J. Apley
*Assistant Examiner*—John Mulcahy
*Attorney, Agent, or Firm*—Pravel, Hewitt, Kimball & Krieger

[57] ABSTRACT

A device that simulates the firing of a firearm. The device includes a piezoelectric crystal for detecting high amplitude acoustic pulses generated when the firing mechanism of the firearm is activated. The piezoelectric crystal provides a voltage pulse to a amplitude detecting circuit. If the pulse generated by the piezoelectric crystal is above a threshold value, the amplitude detecting circuit causes a laser diode to be energized. The laser diode directs a beam at the target to allow the user to determine where the "shot" is fired. The laser diode is activated for a sufficiently long period of time to allow the laser spot to be visible to the human eye and also to allow a streak to be developed if the firearm is pulled slightly by the user when the trigger is pulled. The device is conveniently mounted under the barrel of the firearm.

43 Claims, 4 Drawing Sheets

ACOUSTIC TRIGGERED LASER DEVICE FOR SIMULATING FIREARMS

BACKGROUND OF THE INVENTION

1. Field of the Invention

The invention relates to an apparatus for simulating firearms, and more particularly, to a device for mounting on a firearm which utilizes a laser beam to simulate the firing of real ammunition.

2. Description of the Related Art

Various marksmanship training devices that simulate the firing of a firearm have been developed. These devices allow the owner of a firearm, such as a handgun or a rifle, to improve their shooting skills without the need for live ammunition. Certain devices, such as the one disclosed in U.S. Pat. No. 4,367,516, entitled "MARKSMANSHIP TRAINING DEVICE AND METHOD" by Jacob, require the disassembly of the firearm and replacement with temporary parts to form a device that fires a light beam upon activation of the trigger on the firearm. These devices are generally difficult to use and are limited to those persons who are familiar with the assembly and disassembly of firearms. In an alternative device, disclosed in U.S. Pat. No. 5,237,773, entitled "INTEGRAL LASER SIGHT, SWITCH FOR A GUN" by Claridge, a switch is mounted on the back of the gun handle so that it can be momentarily operated by the thumb of the trigger hand to emit a visible laser beam. However, this provides a poor simulation of real weapon operation, as manual operation of the switch requires the user to deviate from his or her normal grip of the firearm.

In yet another device, described in U.S. Pat. No. 3,938,262 entitled "LASER WEAPON SIMULATOR" by Dye, et al., a piezoelectric crystal mounted on the gun is used to sense shock waves produced by the firing of blank cartridges. In response to the generated shock waves, the piezoelectric crystal oscillates to provide electrical energy to a laser diode, which emits an infrared output pulse. The infrared output pulse, which is invisible to the human eye, strikes an infrared detector located on the target to indicate when a hit is scored. In a second embodiment of the device described in Dye, the piezoelectric crystal is mounted within the cartridge of the rifle such that pulling the trigger causes the hammer of the rifle to hit the piezoelectric crystal. This in turn causes the piezoelectric crystal to provide power to the laser diode for the emission of the infrared pulse. One disadvantage of the first embodiment disclosed in Dye is that costly blank cartridges are required. A disadvantage of the second embodiment of the Dye device is that it is difficult to mount a piezoelectric device into the cartridge of a firearm. The piezoelectric device must be mounted in a very specific location so that the hammer of the gun can make contact.

Another device, disclosed in U.S. Pat. No. 3,633,285, entitled "LASER MARKSMANSHIP TRAINER" by Sensney, detects the acoustical energy generated by the impact of the hammer striking the firing pin when the trigger on the firearm is pulled. In this device, a piezoelectric crystal is also used to sense the acoustical vibrations. The electrical signals generated by the piezoelectric crystal in response to the vibrations are passed through a filter to remove components of the signal that are not produced by the firing mechanism. Sensney discloses either a high pass filter or a bandpass filter to select the desired frequency corresponding to the frequency of the acoustical energy generated by the firing mechanism of a firearm. However, use of such a frequency discrimination device is difficult to implement, as the frequency of the acoustical energy generated by the firing mechanism of a gun shifts with changes in temperature. In addition, different firearms have different frequency characteristics, which would require that the simulation device be modified for different firearms.

Therefore, it is desired that a firearm simulation device be developed that is simple to use and that does not require modification to be used with different types of firearms.

SUMMARY OF THE PRESENT INVENTION

The simulation device according to the present invention includes a means for sensing the acoustical energy developed by the hammer in a firearm falling on the firing pin. The sensing means is preferably a piezoelectric crystal. In a "dry" fire situation, that is, no bullets are actually being fired, the fall of the hammer on the firing pin delivers a higher amplitude pulse then any other action that is likely to befall a gun in normal practice. To sense this high amplitude pulse, the piezoelectric crystal can be placed at any convenient location on the firearm. In response to the pulse generated by the firing mechanism, the piezoelectric crystal provides a high amplitude signal to a amplitude sensing circuit, which is designed to trigger at a sufficiently high voltage so that any other signal source would be below the triggering threshold. If the amplitude sensing circuit provides a signal indicating that a sufficiently high input voltage has just been received, a light emitting device, which is preferably a laser diode, is turned on for a sufficiently long period to allow a visible laser spot to be developed on the target. In addition, the laser diode stays on long enough to show a slight streak to indicate if the gun is being pulled to one side with the pulling of the trigger, which is a common mistake made during the firing of a weapon. Further, the device can be used as a replacement for tracer bullets to indicate where a bullet is being fired. For use in tracer mode, an overvoltage circuit is included in the device to protect the device from the extremely high voltages generated by the piezoelectric crystal in response to the firing of an actual bullet. One of the advantages of the device according to the present invention is that it can be conveniently mounted on the outside of the firearm. Another advantage is that detection of the amplitude of the pulse generated by the firing mechanism is simple to implement, as there are no other mechanisms on the firearm or external stimuli during normal use of the firearm that would cause such a high amplitude pulse.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1B:
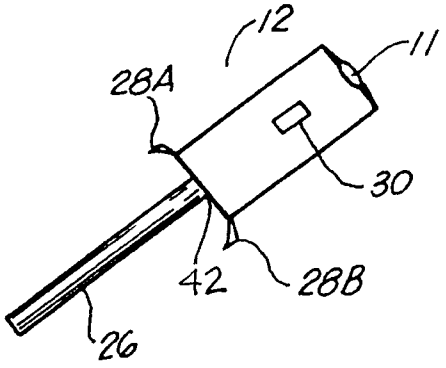
FIG. 1B is a diagram of an alternative embodiment of the simulation device.
Figure 1A:
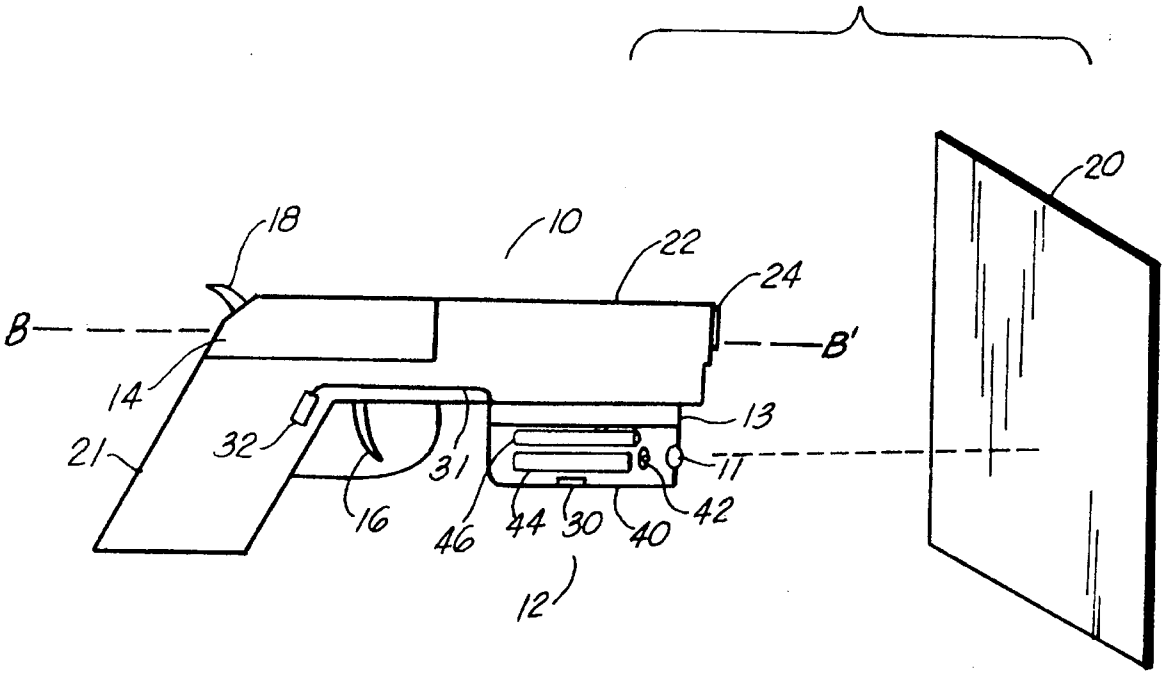
FIG. 1A is a diagram of the simulation device according to the preferred embodiment of the present invention attached to a handgun.

Referring now to FIG. 1A, a simulation device 12 according to the present invention is shown attached to a handgun 10. It is appreciated that the simulation device 12 can be used with other types of firearms, such as rifles. In the preferred embodiment, the attachment of the simulation device 12 to the handgun 10 is accomplished via a mounting bracket 13, which is attached with adhesives to the bottom of the barrel 22 of the handgun 10. The simulation device 12 includes a housing 40, which is slidably mounted onto the mounting bracket 13. Enclosed in the housing 40 of the simulation device 12 is a battery 46 and a cylindrical shaped module 44, which houses a piezoelectric crystal for detecting the acoustical pulse generated by the activation of the firing mechanism on the handgun 10. It is understood that other acoustic sensors, such as various other microphone designs, can be used instead of the piezoelectric crystal. The firing mechanism includes a hammer 18 and a firing pin (not shown) located inside the handgun 10. When a trigger 16 is pulled, the hammer 18 rises and falls on the firing pin. This causes acoustical energy to be generated in the frame of the handgun 10.

The device 12 according to the present invention can also be used with a loaded handgun 10, such as when used in tracer mode. In this case, pulling the trigger 16 would fire the weapon, which would generate much greater acoustical energy. As a result, overvoltage protection circuitry is included in the device 12 to protect it from the acoustical energy generated by the firing of a bullet. In either case, however, the amplitude of the acoustical energy generated by the activation of the firing mechanism is much greater than any acoustical energy that could be caused by other stimuli during normal use of the handgun 10.

The high amplitude pulse generated by the activation of the firing mechanism moves in a direction generally parallel to the axis B—B' of the barrel 22 of the gun 10. The pulse is sensed by the piezoelectric crystal element included in the module 44. In response, other circuitry in the module 44 generate an electrical pulse to activate a laser diode device 42, which emits a beam directed at a target 20. The laser beam is directed through a lens 11 in the housing 40.

An on/off switch 30 is provided on the external surface of the housing 40 to allow the user to disable the simulation device 12. In addition, a switch 32 is provided to allow the user to manually turn on the laser diode device 42 for aiming the handgun 10. Preferably, the manual switch 32 is located on the handle 21 of the handgun 10 for convenient access by the user. The switch 32 is connected to the simulation device 12 via an electrical wire 31. In an alternative embodiment, the on/off switch 30 can be removed, replaced with a plug in line with the manual switch 32. The plug is connected to the module 44 in such a manner that reversing its connection allows the manual switch 32 to act as an on/off switch. Removal of the on/off switch 30 allows for further space savings.

The laser diode device 42 is preferably activated for a few milliseconds in response to the trigger 16 being pulled to allow a visible spot to be temporarily generated on the target 20. If the handgun 10 is pulled slightly to a side when the trigger 16 is being pulled by the user, a streak is developed on the target 20. This streak lets the user know that he or she is firing the handgun improperly. Thus, use of the simulation device 12 allows a user to practice firing the handgun 10 without the need for real bullets. A further advantage is that a user can practice firing the handgun 10 in the convenience of his or her own home, without having to go to a practice firing range.

The simulation device 12 can also be utilized as a replacement for tracer bullets when used in conjunction with a loaded handgun 10. The laser beam generated by the simulation device 12 upon the firing of the handgun 10 indicates where the bullet has been fired. Preferably, a simulation device 12 for use in the tracer mode includes further means for adjusting the on time of the laser diode device 42, such that the laser spot can be observed by a person wearing night vision equipment. A handgun 10 used in tracer mode is adapted with a flash suppressor to eliminate the flash associated with the firing of the handgun 10.

Referring now to FIG. 1B, an alternative embodiment is shown of the simulation device 12. In the alternative embodiment, a shaft 26 has been provided for fitting down the bore of the barrel 22 of the handgun 10. Clamps **28*a* and 28*b* are used to secure the simulation device 12 to the tip 24 of the barrel 22. The alternative embodiment allows the simulation device 12 to be more easily retrofitted to existing firearms without the need for permanent mounting. However, use of the simulation device 12 in this manner may present a safety hazard if the user is not careful, since firing a live bullet with the device 12 fitted down the bore of the barrel 22 will cause the handgun 10** to explode.

In yet another embodiment, the simulation device 12 is encased in a housing shaped like a flanged cartridge, which can be inserted from the rear of the barrel 22 by temporarily removing the weapon slide 14 of the handgun 10. This configuration also allows the simulation device 12 to be used without permanently mounting it to the handgun 10, while ensuring that live bullets cannot accidentally be fired.

Figure 2:
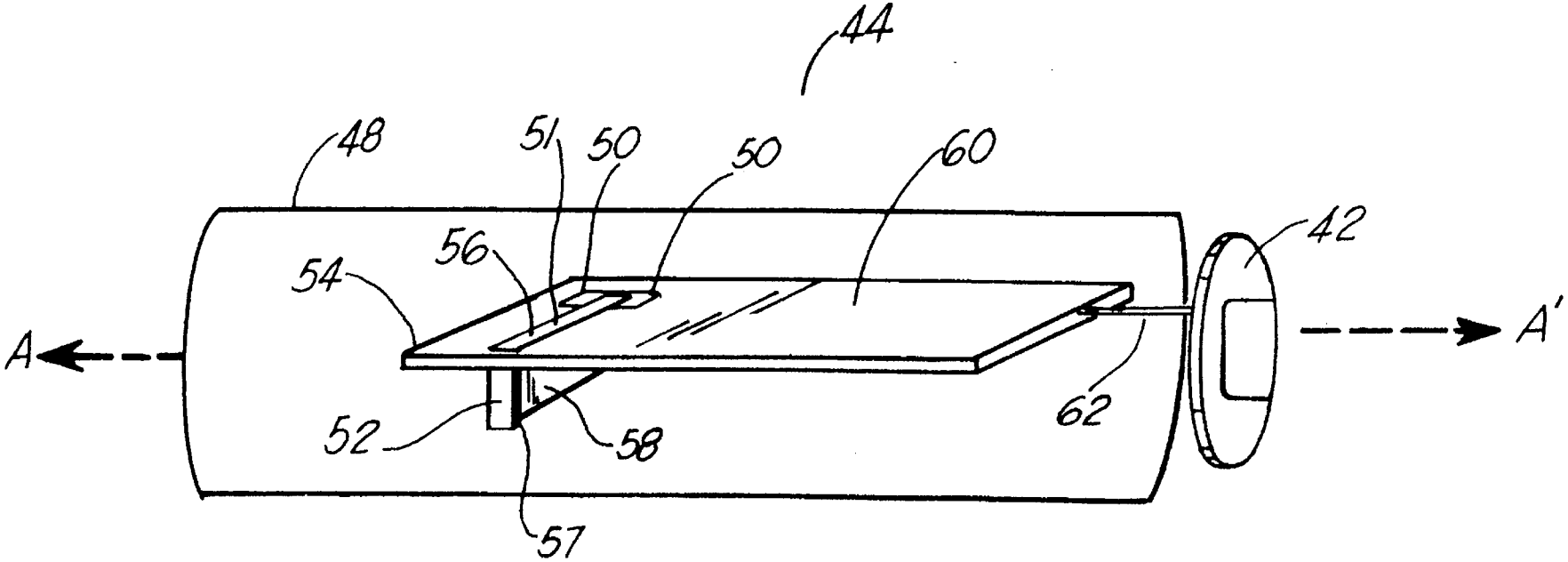
FIG. 2 is a diagram of a module in the simulation device of FIG. 1A containing a piezoelectric crystal and circuitry responsive to the piezoelectric crystal for powering a laser diode.

Referring now to FIG. 2, the module 44 containing the piezoelectric crystal and other circuitry is shown in greater detail. For clarity, the components shown in FIG. 2 are not drawn to scale. Enclosed in the casing 48 of the module 44 are a circuit board 54, the laser diode device 42 and a piezoelectric crystal 58. The laser diode device 42 is electrically connected to the circuit board 54 by electrical wires 62. Circuitry for responding to the piezoelectric crystal 58 and for activating the laser diode device 42 are implemented on the upper surface 60 of the circuit board 54. For better clarity, the details of how the circuit board 54 and the laser diode device 42 are mounted inside the casing 48 of the module 44 are not shown, as those details are readily apparent to those skilled in the art. The module 44 is positioned such that its length runs along a line A—A'. The line A—A' is generally parallel to the axis B—B' of the barrel 22 of the handgun 10. The circuit board 54 is mounted inside the casing 48 of the module 44 such that the surface 60 of the circuit board 54 is also generally parallel to the line A—A'.

A slot 56 is cut along the width of the circuit board 54 at one end. One edge 51 of a cantilever beam 52 is fitted into the slot 56. The cantilever beam 52 protrudes from the bottom surface of the circuit board 54, and its front surface 57 is generally perpendicular to the bottom surface of the circuit board 54. The front surface 57 of the cantilever beam 52 is also generally perpendicular to the line A—A'. The piezoelectric crystal 58 is made from a material known as polyvinylidene fluoride, which is flexible in nature and is not subject to fracture as are most other piezo materials. A thin film of the piezoelectric crystal 58 is coated onto the front surface 57 of the cantilever beam 52, such that the surface of the piezoelectric crystal 58 is also generally perpendicular to the line A—A'. The piezoelectric crystal 58 is preferably unidirectional; that is, it is more sensitive to acoustical energy traveling along one direction and much less sensitive to acoustical energy traveling in a perpendicular direction. Thus, in the preferred embodiment, the piezoelectric crystal 58 is more sensitive to acoustical energy traveling in a direction generally parallel to line A—A' and much less sensitive to acoustical energy traveling in a direction generally perpendicular to the line A—A'.

As discussed above, shock waves generated by the firing mechanism of the handgun 10 travel in a direction generally parallel to the axis B—B' of the barrel 22. By positioning the cantilever beam 52 such that its surface 57 is generally perpendicular to the direction of the acoustical energy pulse, and by using a unidirectional piezo element, the piezoelectric crystal 58 is made more sensitive to acoustical energy generated by the firing mechanism.

Additionally, the motion of the cantilever beam 52 causes the piezoelectric crystal 58 to be even more sensitive to acoustical energy traveling in a direction generally parallel to line A—A'. The cantilever beam 52 is made of a resilient material, and shock waves generated by the firing mechanism of the gun causes the cantilever beam 52 to initially deflect in the direction of the shock waves. Due to its resilient nature, the cantilever beam then swings back in the opposite direction to begin oscillating. After a short while, the oscillation of the cantilever beam 52 dies down.

In response to the acoustical energy pulse, the piezoelectric crystal 58 generates electrical pulses, which are routed to circuitry on the circuit board 54 via solder pads 50. Triggering circuitry and driver circuitry on the circuit board 54 then provides electrical signals through electrical wires 62 to activate the laser diode device 42, which responds by emitting a laser beam.

Figure 3:
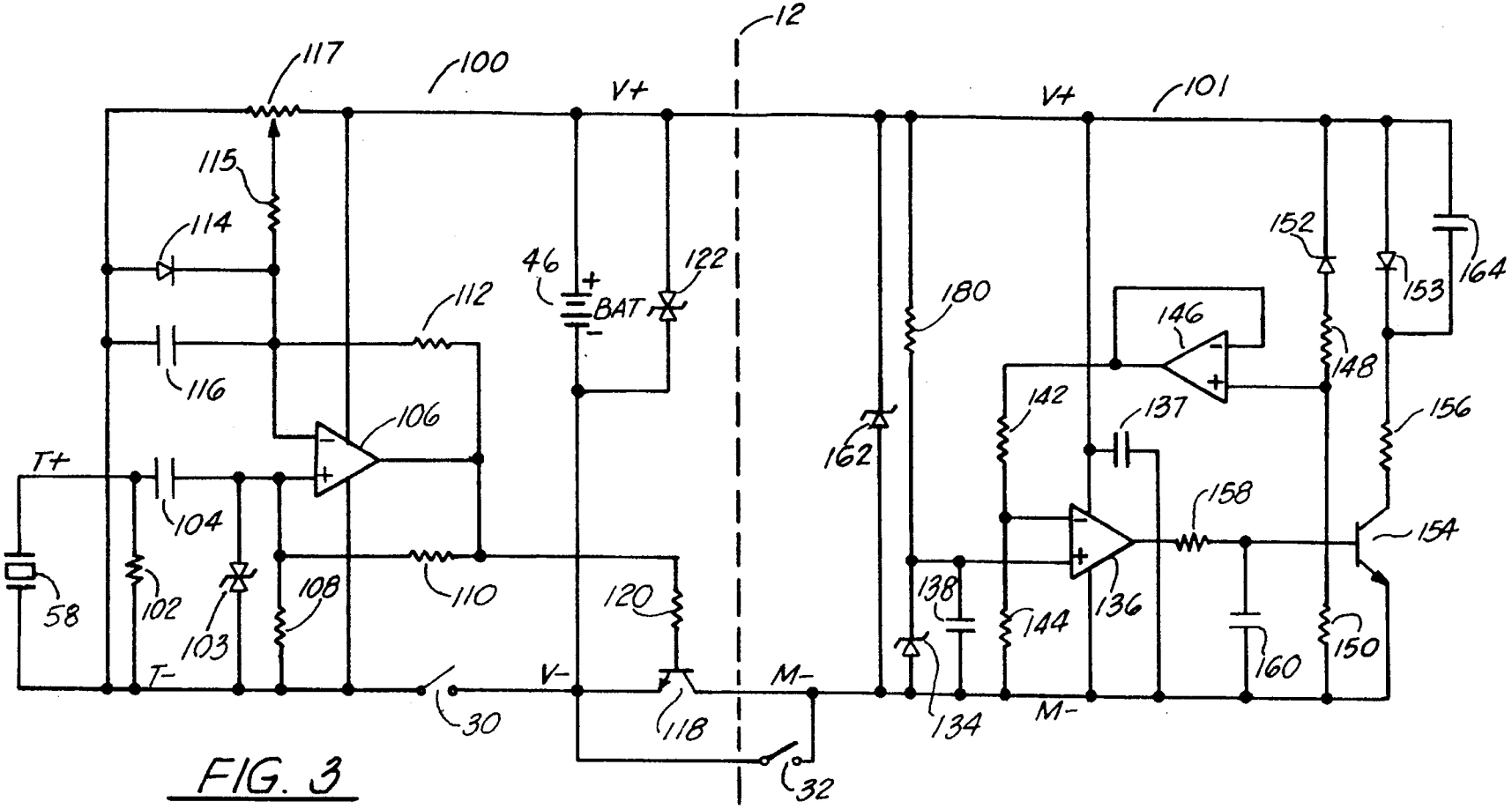
FIG. 3 is a schematic diagram of circuitry responsive to acoustical energy generated by the activation of the firing mechanism of the handgun for powering a laser diode to emit a laser beam onto a target.

Referring now to FIG. 3, a schematic diagram is shown of a trigger circuit 100 responsive to acoustical energy generated in the handgun 10 and a driver circuit 101 for powering the laser diode 42, both of which are implemented on the circuit board 54. In response to the high amplitude acoustical energy generated by the hammer 18 falling on the firing pin when the trigger 16 is pulled, the piezoelectric crystal 58 provides a voltage pulse between nodes T+ and T–. A resistor 102 is connected between the nodes T+ and T– to remove any DC static charges from the outputs of the piezoelectric crystal 58. A capacitor 104 is connected between node T+ and the non-inverting input of an amplifier 106 to further provide DC blocking. The power supply inputs to the amplifier 106 are provided by the battery 46, which is connected between supply nodes V+ and V–. The battery voltage across the battery 46 is preferably 3 volts. A resistor 108 is connected between the non-inverting input of the amplifier 106 and node T–, and a feedback resistor 110 is connected between the non-inverting input and the output of the amplifier 106. A high voltage protection device 103, preferably a varistor, is connected between the non-inverting input of the amplifier 106 and node T–. The inverting input of the amplifier 106 is connected to the cathode of a diode 114 and to one node of a capacitor 116. The anode of the diode 114 and the second node of the capacitor 116 are connected to the node T–. A feedback resistor 112 is connected between the output of the amplifier 106 and its inverting input. In addition, a resistor 115 is connected between the inverting input of the amplifier 106 and the wiper of a potentiometer 117, which has its fixed resistor connected between the supply node V+ and the node T–. The output of the amplifier 106 is connected to the base of an NPN transistor 118 through a resistor 120. The emitter of the transistor 118 is connected to node V– and its collector is connected to a node M–.

In operation, the steady state condition of the output of the amplifier 106 is 0 volts. A positive voltage pulse is generated between nodes T+ and T– by the piezoelectric crystal 58 in response to acoustical energy, such as that generated by the firing mechanism of the handgun 10. The piezoelectric crystal 58 may also generate a voltage pulse in response to other stimuli, which include the user bumping the handgun 10 with his or her hands. However, the voltage pulse generated by the piezoelectric crystal 58 in response to the latter stimuli is much smaller than the voltage pulse caused by the hammer 18 hitting the firing pin when the trigger 16 is pulled. Additionally, use of a unidirectional piezo element minimizes the sensitivity of the piezoelectric crystal 58 to acoustical energy not moving in a direction generally parallel to the line A—A'. The voltage pulse is provided to the non-inverting input of the amplifier 106 through the capacitor 104, which filters out any DC voltage components on the input voltage. If the pulse is an excessively large voltage, such as that generated when an actual bullet is fired, the varistor 103 protects the amplifier 106 by limiting the magnitude of the voltage that can exist at the non-inverting input of the amplifier 106. The varistor 103 accomplishes this by shunting current from the node connected to the non-inverting input of the amplifier 106 to node T–.

If the voltage pulse provided to the non-inverting input is above a certain threshold voltage, then the amplifier 106 drives its output to a positive voltage. The threshold voltage is determined by the potentiometer 117. By varying the wiper location of the potentiometer 117, the voltage at the inverting input of the amplifier is varied. The threshold voltage value is variable to allow for flexibility so that the threshold value can be adjusted if needed according to the type of gun and the environment of anticipated use. If the input voltage pulse has a magnitude that is lower than the threshold voltage, which would usually be the case for external stimuli provided to the handgun 10 other than the activation of the firing mechanism, the input voltage pulse is ignored. If the voltage pulse is of sufficient magnitude, the positive voltage developed at the output of the amplifier 106 causes a bias voltage to be developed at the non-inverting input of the amplifier 106 through the voltage divider formed by the resistors 108 and 110. The voltage level of the bias voltage is determined by the ratio of the resistors 108 and 110.

The capacitor 116 is gradually charged to the bias voltage existing at the non-inverting input of the amplifier 106 through the resistor 112. When the voltage across the capacitor 116 reaches the bias voltage existing on the non-inverting input of the amplifier 106, the amplifier 106 is turned off since the voltage difference between the inputs of the amplifier 106 is zero. As a result, the output of the amplifier 106 is driven to zero volts, which causes the transistor 118 to shut off. The capacitor 116 is then gradually discharged back down to zero volts through the resistor 112. It is noted that the output of the amplifier 106 will never go negative in the preferred embodiment, since the negative power supply input of the amplifier 106 is connected to node T–, which remains at zero volts. The effective pulse width of the output signal from the amplifier 106 is determined by the RC timing formed by the resistor 112 and the capacitor 116 and by the bias voltage determined by the resistors 108 and 110. The pulse width of the output pulse of the amplifier 106 is preferably set at a few milliseconds.

The diode 114 is provided to prevent oscillation and to ensure a one-shot pulse output at the output of the amplifier 106. A high voltage protection device or varistor 122 is connected between nodes V+ and V− to protect the amplifier 106 from high voltage conditions, such as those caused by static charges. Also, the on/off switch 30 is connected between nodes T− and V−. If the on/off switch 30 is set in the open position, the trigger circuit 100 is disabled.

In the driver circuit 101, the external manual switch 32 is connected between node M− and node V− to manually turn on the laser diode device 42 if desired. In normal operation, the switch 30 is closed and the switch 32 is open. When the transistor 118 is turned on by the amplifier 106, the laser driver circuit 101 is energized by allowing the battery voltage to be developed across nodes V+ and M−. The anode of a Zener diode 134 is connected to node M− and its cathode is connected to the non-inverting input of an amplifier 136. The supply voltage inputs of the amplifier 136 are connected to nodes V+ and M−. A capacitor 137 is connected between nodes V+ and M− to remove high frequency noise. Another capacitor 138 for removing high frequency noise signals is connected between the non-inverting input of the amplifier 136 and node M−. A resistor 140 is connected between the supply node V+ and the non-inverting input of the amplifier 136. The inverting input of the amplifier 136 is connected to the center node of a voltage divider formed by resistors 142 and 144. The other node of the resistor 144 is connected to node M− and the other node of the resistor 142 is connected to the output of an amplifier 146. The amplifier 146 is configured as a voltage follower having a unity voltage gain. The output of the amplifier 146 is connected directly to its inverting input. A resistor 150 is connected between the non-inverting input of the amplifier 146 and node M−. A resistor 148 is connected between the non-inverting input of the amplifier 146 and the anode of a pin diode 152, which is essentially a photodetecting diode. The resistors 148 and 150 form a voltage divider.

The cathode of the pin diode 152 is connected to the supply node V+ and also to the anode of a laser diode 153. The pin diode 152 and the laser diode 153 are located inside the laser diode device 42. The cathode of the laser diode 153 is connected to the collector of an NPN transistor 154 through a resistor 156. A capacitor 164 is connected between the cathode of the laser diode 153 and node V+ to bypass and protect the laser diode 153 from high frequency switching currents occurring in power turn-on states. The emitter of the transistor 154 is connected to node M− and its base is connected to the output of the amplifier 136 through a resistor 158. A capacitor 160 is also connected between the base of the transistor 154 and node M−. In addition, a capacitor 164 is connected between the cathode of the laser diode 153 and the positive supply node V+ to remove high frequency noise signals.

In operation, the voltage at the non-inverting input of the amplifier 136 is regulated by the Zener diode 134 when the NPN transistor 118 is turned on. In response to this regulated voltage, which is preferably approximately 1.2 volts, the amplifier 136 drives its output to a positive voltage, thereby turning the transistor 154 on. When the transistor 154 is turned on, current is allowed to flow from the supply node V+ through the laser diode 153, the resistor 156 and the transistor 154 to node M−. The current flow through the laser diode 153 causes a laser beam to be emitted. As the laser diode 153 is turned on only for as long as the transistor 118 is turned on, the duration of the laser beam is determined by the resistor 112 and the capacitor 116.

Portions of the emitted laser beam from the laser diode 153 are received by the pin diode 152. The emitted light energy from the laser diode 153 causes the effective resistance of the pin diode 152 to decrease. With the decrease in the resistance of the pin diode 152, the voltage seen at the non-inverting input of the amplifier 146 is proportionately increased. This increase is directly translated to the output of the amplifier 146, which in turn causes the voltage at the inverting input of the amplifier 136 to increase. Thus the higher the power output of the laser diode 153, the higher the voltage at the inverting input of the amplifier 136. This increase in the voltage at the inverting input of the amplifier 136 reduces the voltage difference at the inputs of the amplifier 136, which causes the output voltage of the amplifier 136 to be reduced. As a result, the feedback path provided by the pin diode 152, the voltage divider formed from resistors 148 and 150, the voltage follower 146 and a voltage divider formed from the resistors 142 and 144, serves to control the amount of current that can flow through the laser diode 153 by adjusting the base current of the transistor 154.

High voltage surges that may appear at the non-inverting input of the amplifier 136 are dampened by the RC network formed by the resistor 158 and the capacitor 160. Further, the resistor 156 serves as a current limiting device to protect the laser diode 153. A Zener diode 162 is connected between the power supply node V+ and node M− to serve as a high voltage protection device. The Zener diode 162 is capable of passing large amounts of current to regulate the voltage between nodes V+ and M− at the desired level.

Figure 4:
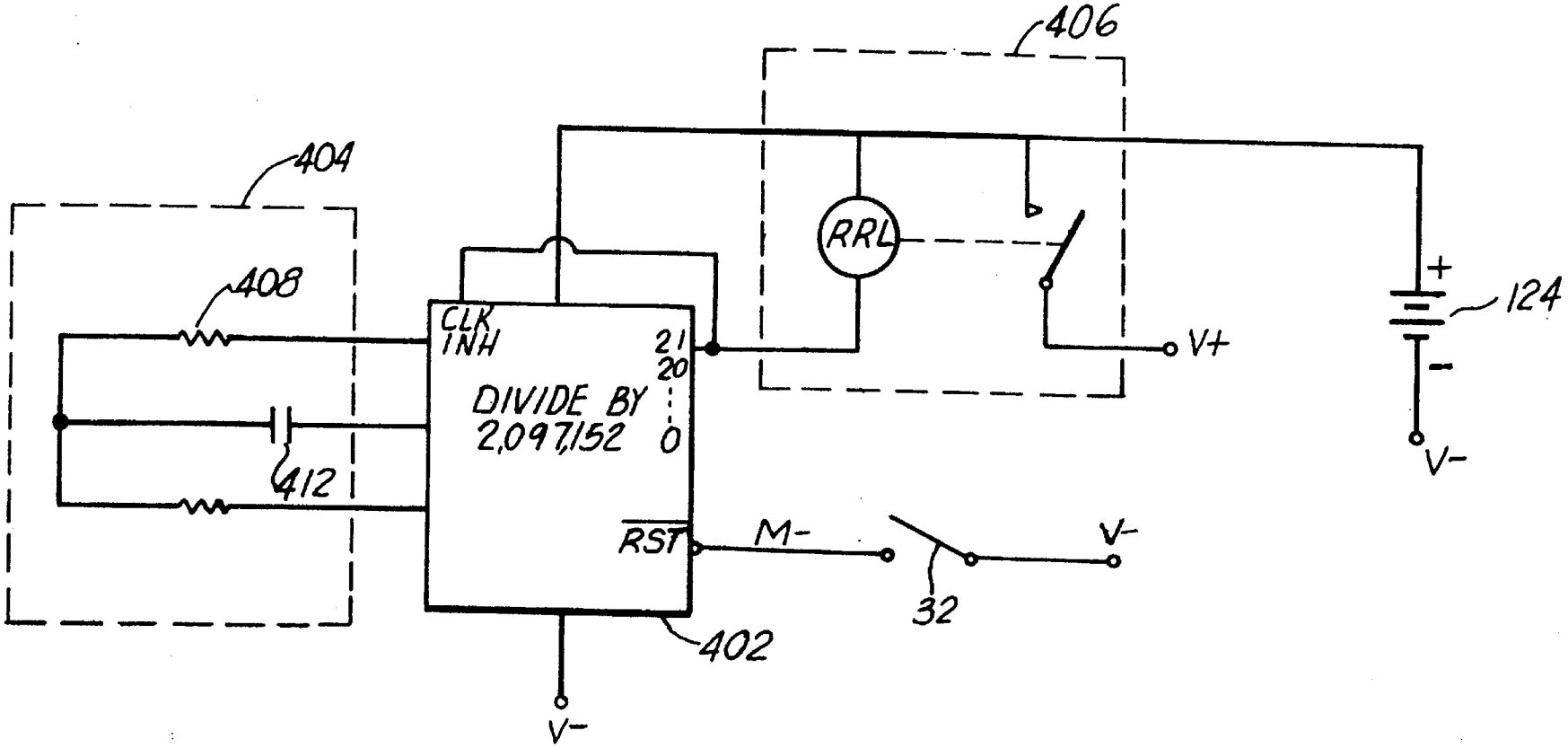
FIG. 4 is a schematic diagram of the circuitry of FIG. 3 in which the on/off switch has been replaced by REED relay circuitry.

In an alternative embodiment, the switch 30 can be eliminated for improved reliability and space savings. In this embodiment, shown in FIG. 4, to which reference is now made, the negative terminal of the battery 124 is still connected to node V−, but its positive terminal is connected instead to a Reed relay 406, which takes the place of the switch 30. When energized, the relay 406 connects the positive terminal of the battery 124 to node V+ when output bit 21 of a 22-bit counter 402 is deasserted low. When the relay 406 is deenergized, i.e., node V+ is disconnected from the positive terminal of the battery 124, power is removed from the trigger circuit 100. The power supply terminals of the counter 402 are connected to the positive and negative terminals of the battery 124. The counter 402 also has a RST* input connected to node M−, which is connected through the manual switch 32 to node V−.

When the manual switch 32 is closed, the RST* input of the counter 402 is pulled low, causing the counter 402 to reset to the value 0. When the switch 32 is released, the counter 402 begins to count. The counter 402 is clocked by an oscillator 404 comprising two resistors 408 and 410 and a capacitor 412 connected in parallel, which preferably generate a 1 KHz clock. At this point, output bit 21 is low, which energizes the relay 406 to provide power to the trigger circuit 100, as well as to the driver circuit 101 while the manual switch 32 remains closed. When the counter 402 counts to the value $2^{21}$, which is approximately 33 minutes later, output bit 21 is asserted high to deenergize the relay 406, thereby removing power from the trigger circuit 100. Output bit 21 is also connected to a clock inhibit input of the counter 402. When the clock inhibit input is asserted high, the counter 402 stops counting.

Thus, by activating switch 32, the relay 406 is energized to provide power to the trigger circuit 100. At this point, the laser diode 153 is also manually turned on. When the manual switch 32 is released, the laser diode 153 turns off but the relay 406 remains energized for approximately 33 minutes, keeping the trigger circuit 100 active. After 33 minutes, the relay 406 is deenergized and the trigger circuit 100 is powered off. In this alternative embodiment, only one switch 32 is needed. As a result, the size of the simulation device 12 can be further reduced.

Thus, a device has been described that simulates the firing of a firearm. The device includes a piezoelectric crystal for detecting high amplitude acoustic pulses generated when the firing mechanism of the firearm is activated. The piezoelectric crystal provides a voltage pulse to a amplitude detecting circuit. If the pulse generated by the piezoelectric crystal is above a threshold value, the amplitude detecting circuit causes a laser diode to be energized. The laser diode directs a beam at the target to allow the user to determine where the "shot" is fired. The laser diode is activated for a sufficiently long period of time to allow the laser spot to be visible to the human eye and also to allow a streak to be developed if the firearm is pulled slightly by the user when the trigger is pulled. The device is conveniently mounted under the barrel of the firearm.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

I claim:

1. A device for mounting on a firearm and for momentarily emitting a beam of light to simulate the firing of the firearm, wherein the firearm includes a firing mechanism, and wherein activation of the firing mechanism causes an acoustical energy pulse to be generated, the device comprising:

means for sensing the acoustical energy and producing a voltage pulse having an amplitude in response to the acoustical energy pulse, said voltage pulse amplitude being proportional to the energy of the acoustical energy pulse;

means for setting a threshold voltage;

an amplifier having a non-inverting input, an inverting input, and an output, wherein the inverting input is coupled to said means for setting a threshold voltage and the non-inverting input is coupled to said means for sensing;

means coupled to the output of said amplifier for asserting an activation signal for at least a predetermined duration if said voltage pulse amplitude is above said threshold voltage;

means for emitting the beam of light when powered; and means responsive to said activation signal and coupled to said light beam emitting means for powering said light beam emitting means when said activation signal is asserted.

2. The device of claim 1, further comprising:

a battery, wherein said amplifier further includes a positive supply terminal and a negative supply terminal, said positive supply terminal being connected to the positive terminal of said battery, and said negative supply terminal being connected to the negative terminal of said battery.

3. The device of claim 1, further including:

a first resistor connected between the output of said amplifier and the non-inverting input of said amplifier; and a second resistor connected between the non-inverting input of said amplifier and a ground signal, wherein said first and second resistors form a voltage divider to generate a bias voltage at said non-inverting input from a voltage developed at said amplifier output in response to said input voltage pulse.

4. The device of claim 3, wherein said activation signal asserting means includes:

a third resistor connected between the output of said amplifier and the inverting input of said amplifier; and a capacitor connected between the inverting input of said amplifier and the ground signal, wherein said capacitor is charged by the output of said amplifier through said third resistor, said capacitor being charged to said bias voltage to cause said amplifier to shut off, and wherein said predetermined duration for asserting said activation signal is determined by the time constant corresponding to said third resistor and said capacitor.

5. The device of claim 1, wherein said threshold voltage setting means is adjustable to vary said threshold voltage.

6. The device of claim 1, further comprising:

means coupled to said amplifier for protecting said amplifier and said activation signal asserting means from voltage pulses having large amplitudes generated by said acoustical energy sensing means in response to high acoustical energy.

7. The device of claim 1, further comprising:

a battery;

a manual switch being coupled to said battery and said powering means, said manual switch when activated causing said powering means to power said light beam emitting means; and relaying means coupled to said manual switch, said activation signal asserting means, and said battery, wherein said relaying means energizes to connect said battery to said activation signal asserting means to enable assertion of said activation signal when said manual switch is activated, and wherein said relaying means deenergizes to disconnect said battery from said activation signal asserting means to disable assertion of said activation signal a predetermined period of time after said manual switch is deactivated.

8. The device of claim 1, further comprising:

a battery, wherein said threshold voltage setting means includes:

a potentiometer connected to said battery and having a wiper, wherein said threshold voltage is developed from said battery by said potentiometer, and wherein the location of said wiper is adjustable for varying said threshold voltage.

9. The device of claim 1, wherein said means for sensing the acoustical energy includes a piezoelectric crystal element.

10. The device of claim 9, wherein the firearm further includes a barrel having an axis, and wherein said piezoelectric crystal element is more sensitive to acoustical energy pulses traveling along a specific direction, the device further comprising:

a housing adapted for mounting to the firearm; and means mounted inside said housing for securing said piezoelectric crystal element, said piezoelectric crystal element being positioned such that said specific direction in which said piezoelectric crystal element is more sensitive is generally parallel to the barrel axis of the firearm.

11. The device of claim 10, wherein said securing means includes:

cantilever means for securing said piezoelectric crystal element, said cantilever means having an edge and a planar surface, wherein said edge is coupled to said housing and said piezoelectric crystal element is attached to said planar surface, wherein said cantilever means is resilient, wherein said planar surface is generally perpendicular to the barrel axis of the firearm, and wherein the acoustical energy pulse generated by the activation of the firing mechanism deflects said planar surface of said cantilever means.

12. The device of claim 11, wherein said piezoelectric crystal element is a thin film piezo material coated to said planar surface.

13. The device of claim 12, wherein said piezo material is polyvinylidene fluoride.

14. The device of claim 1, wherein said light beam emitting means includes a laser diode.

15. The device of claim 1, further comprising:

a battery, wherein said powering means further includes switching means responsive to said activation signal, said switching means being connected to said battery and coupled to said light beam emitting means for connecting said battery to said light beam emitting means when said activation signal is asserted.

16. The device of claim 15, wherein said switching means is a transistor.

17. The device of claim 15, wherein a current flows through said light beam emitting means when said battery voltage is connected, and wherein said powering means further includes:

means coupled to said light beam emitting means for adjusting the amount of said current flowing through said light beam emitting means.

18. The device of claim 17, wherein said powering means further includes:

means coupled to said current adjusting means for detecting the intensity of the light beam emitted from said light beam emitting means, wherein said adjusting means decreases said current flowing through said light beam emitting means if the intensity of the light beam emitted increases.

19. The device of claim 18, wherein said threshold voltage setting means is adjustable to vary said threshold voltage.

20. The device of claim 18, wherein said light intensity detecting means includes a photodetecting diode.

21. The device of claim 20, wherein said photodetecting diode has a resistance, wherein said photodetecting diode resistance varies inversely proportionally with the intensity of the emitted light beam, wherein the cathode of said photodetecting diode is connected to said battery, and wherein said current adjusting means includes:

means connected to the anode of said photodetecting diode for providing an output voltage, wherein said output voltage varies inversely proportionally with said resistance of said photodetecting diode;

means for developing a reference voltage;

an amplifier having a non-inverting input, an inverting input, and an output, said non-inverting input being connected to said reference voltage, and said inverting input being connected to said output voltage; and a transistor coupled to said amplifier output and to said light beam emitting means, said amplifier output controlling the amount of current flowing through said transistor to control said current flowing through said light beam emitting means.

22. The device of claim 21, wherein said means for generating said reference voltage includes a Zener diode having a cathode and an anode, said cathode being connected to said non-inverting input of said amplifier and said anode being connected to a ground signal.

23. The device of claim 21, wherein said output voltage providing means includes a voltage divider formed from a first resistor and a second resistor, said first resistor being connected between said photodetecting diode and a first node, said second resistor being connected between said first node and a ground signal, and said output voltage being coupled to said first node.

24. The device of claim 21, wherein said transistor is an NPN bipolar junction transistor having a base, an emitter, and a collector, said base being coupled to said amplifier output, said emitter being coupled to a ground signal, and said collector being coupled to said light beam emitting means.

25. The device of claim 24, wherein said light beam emitting means is a laser diode having a cathode and an anode, said cathode being coupled to said collector of said NPN bipolar junction transistor, and said anode being coupled to said battery.

26. A device for mounting on a firearm and for momentarily emitting a beam of light to simulate the firing of the firearm, wherein the firearm includes an external surface and a firing mechanism, and wherein activation of the firing mechanism causes an acoustical energy pulse to be generated, the device comprising:

a housing adapted for attachment to the external surface of the firearm;

means positioned inside said housing for sensing the acoustical energy and producing a voltage pulse having an amplitude in response to the acoustical energy pulse, said voltage pulse amplitude being proportional to the energy of the acoustical energy pulse;

a circuit board mounted inside said housing, wherein said circuit board is electrically contacted to said sensing means, and wherein said circuit board includes:

means for setting a threshold voltage;

an amplifier having a non-inverting input, an inverting input, and an output, wherein the inverting input is coupled to said means for setting a threshold voltage and the non-inverting input is coupled to said sensing means; and means coupled to the output of said amplifier for asserting an activation signal for at least a predetermined duration if said voltage pulse amplitude is above said threshold voltage; and means mounted inside said housing and coupled to said circuit board for emitting the beam of light when powered, wherein said circuit board further includes:

means responsive to said activation signal and coupled to said light beam emitting means for powering said light beam emitting means when said activation signal is asserted.

27. The device of claim 26, further including:

a first resistor connected between the output of said amplifier and the non-inverting input of said amplifier; and a second resistor connected between the non-inverting input of said amplifier and a ground signal, wherein said first and second resistors form a voltage divider to generate a bias voltage at said non-inverting input from a voltage developed at said amplifier output in response to said input voltage pulse.

28. The device of claim 27, wherein said activation signal asserting means includes:

a third resistor connected between the output of said amplifier and the inverting input of said amplifier; and a capacitor connected between the inverting input of said amplifier and the ground signal, wherein said capacitor is charged by the output of said amplifier through said third resistor, said capacitor being charged to said bias voltage to cause said amplifier to shut off, and wherein said predetermined duration for asserting said activation signal is determined by the time constant corresponding to said third resistor and said capacitor.

29. The device of claim 26, wherein said threshold voltage setting means is adjustable to vary said threshold voltage.

30. The device of claim 29, further comprising:

a battery, wherein said threshold voltage setting means includes:

a potentiometer connected to said battery and having a wiper, wherein said threshold voltage is developed from said battery by said potentiometer, and wherein the location of said wiper is adjustable for varying said threshold voltage.

31. The device of claim 26, wherein said means for sensing the acoustical energy includes a piezoelectric crystal element.

32. The device of claim 31, wherein the firearm further includes a barrel having an axis, and wherein said piezoelectric crystal element is more sensitive to acoustical energy pulses traveling along a specific direction, the device further comprising:

means coupled to said circuit board for securing said piezoelectric crystal element, said piezoelectric crystal element being positioned such that said specific direction in which said piezoelectric crystal element is more sensitive is generally parallel to the barrel axis of the firearm.

33. The device of claim 32, wherein said securing means includes:

cantilever means for securing said piezoelectric crystal element, said cantilever means having an edge and a planar surface, wherein said edge is coupled to said circuit board and said piezoelectric crystal element is attached to said planar surface, wherein said cantilever means is resilient, wherein said planar surface is generally perpendicular to the barrel axis of the firearm, and wherein the acoustical energy pulse generated by the activation of the firing mechanism deflects said planar surface of said cantilever means.

34. The device of claim 33, wherein said piezoelectric crystal element is a thin film piezo material coated to said planar surface.

35. The device of claim 34, wherein said piezo material is polyvinylidene fluoride.

36. The device of claim 26, wherein said light beam emitting means includes a laser diode.

37. The device of claim 26, further comprising:

a battery, wherein said powering means includes switching means responsive to said activation signal, said switching means being connected to said battery and coupled to said light beam emitting means for connecting said battery to said light beam emitting means when said activation signal is asserted.

38. The device of claim 37, wherein a current flows through said light beam emitting means when said battery voltage is connected, and wherein said powering means further includes:

means coupled to said light beam emitting means for adjusting the amount of said current flowing through said light beam emitting means.

39. The device of claim 38, wherein said powering means further includes:

means coupled to said current adjusting means for detecting the intensity of the light beam emitted from said light beam emitting means, wherein said adjusting means decreases said current flowing through said light beam emitting means if the intensity of the light beam emitted increases.

40. The device of claim 39, wherein said light intensity detecting means includes a photodetecting diode.

41. The device of claim 26, further comprising:

means coupled to said amplifier for protecting said amplifier and said activation signal asserting means from voltage pulses having large amplitudes generated by said acoustical energy sensing means in response to high acoustical energy.

42. The device of claim 26, further comprising:

a battery;

a first manual switch being coupled to said battery and said activation signal asserting means, said first manual switch when activated connecting said battery to said activation signal asserting means to enable assertion of said activation signal; and a second manual switch being coupled to said battery and said powering means, said second manual switch when activated causing said powering means to power said light beam emitting means.

43. The device of claim 26, further comprising:

a battery;

a manual switch being coupled to said battery and said powering means, said manual switch when activated causing said powering means to power said light beam emitting means, wherein said circuit board further includes relaying means coupled to said manual switch, said activation signal asserting means, and said battery, wherein said relaying means energizes to connect said battery to said activation signal asserting means to enable assertion of said activation signal when said manual switch is activated, and wherein said relaying means deenergizes to disconnect said battery from said activation signal asserting means to disable assertion of said activation signal a predetermined period of time after said manual switch is deactivated.

* * * * *